United States Patent [19]

Van Auken

[11] 4,433,840

[45] * Feb. 28, 1984

[54] ELECTRICALLY CONDUCTIVE GAME BALL

[76] Inventor: John A. Van Auken, 16 La Gorce Cir., Miami Beach, Fla. 33141

[ * ] Notice: The portion of the term of this patent subsequent to Nov. 10, 1998 has been disclaimed.

[21] Appl. No.: 320,066

[22] Filed: Nov. 10, 1981

Related U.S. Application Data

[63] Continuation of Ser. No. 77,729, Sep. 21, 1979, Pat. No. 4,299,384, which is a continuation-in-part of Ser. No. 683,283, May 5, 1976, abandoned, which is a continuation-in-part of Ser. No. 570,766, Apr. 23, 1975, abandoned.

[51] Int. Cl.[3] ..... A63B 61/00

[52] U.S. Cl. ..... 273/61 R

[58] Field of Search ..... 273/61 R, 58 G

[56] References Cited

U.S. PATENT DOCUMENTS 4,299,384 11/1981 Van Auken ..... 273/61 R

*Primary Examiner*—George J. Marlo

*Attorney, Agent, or Firm*—LeBlanc, Nolan, Shur & Nies

[57] ABSTRACT

A tennis ball having a cover and a multiplicity of electrically conductive fibers which are incorporated with the cover and which have portions extending on the outer surface of the cover to effectively render the ball's outer surface electrically conductive, whereby said ball is capable of completing an electrical circuit across spaced apart electrical conductors lying in a selected area on a tennis court for the purpose of detecting or sensing touchdown of the ball in said area. The electrically conductive fibers may be needle punched through the cover and they may be formed by coating synthetic fibers with an electrically conductive material such as a tin-containing oxide, or silver-plated nylon fibers may be used. An electrically conductive scrim or open mesh of fibers may be located along the inner surface of the cover to provide needed conductivity. A sulphur-free adhesive may be used to secure the cover to the ball.

1 Claim, 11 Drawing Figures

FIG. 1
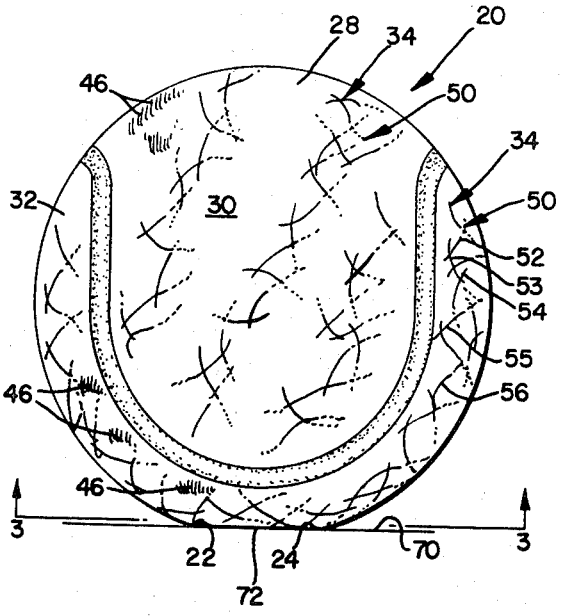
FIG. 2
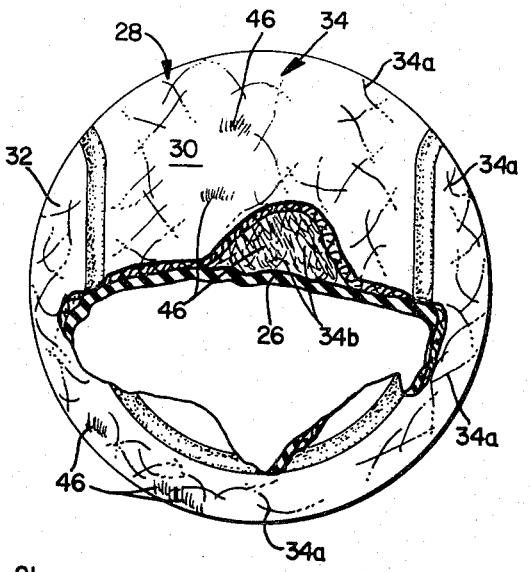
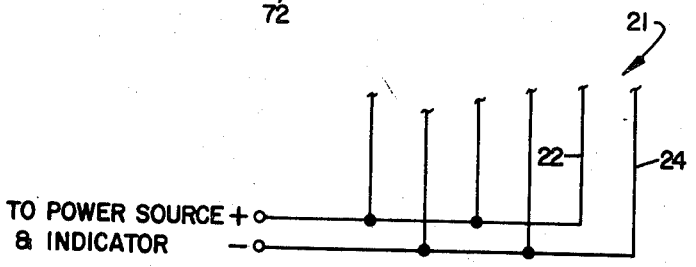
FIG. 1A
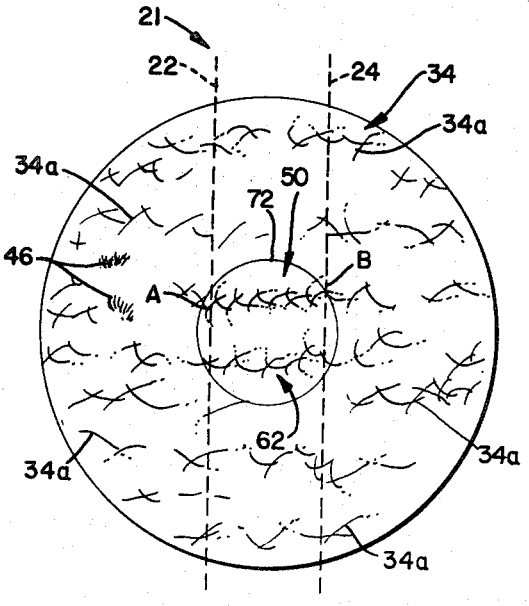
FIG. 3
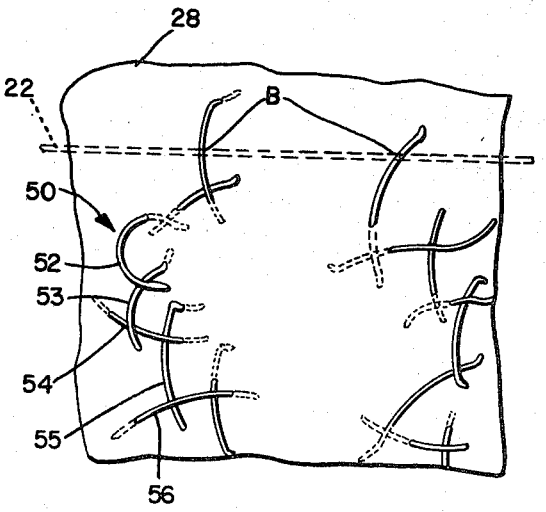
FIG. 4

FIG. 5
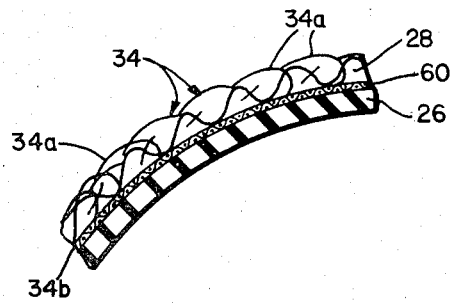
FIG. 6A
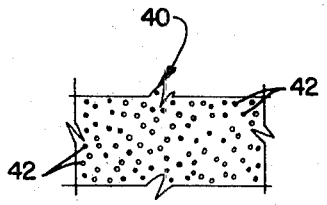
FIG. 6
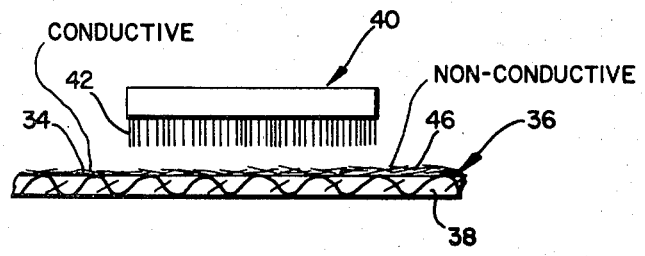
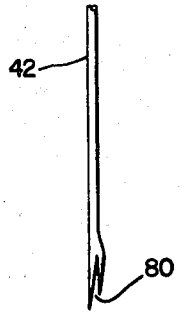
FIG. 8
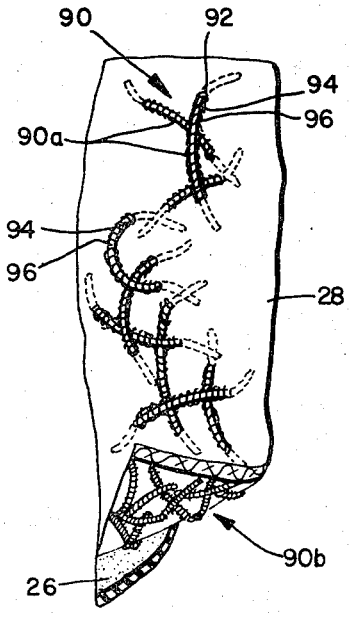
FIG. 9
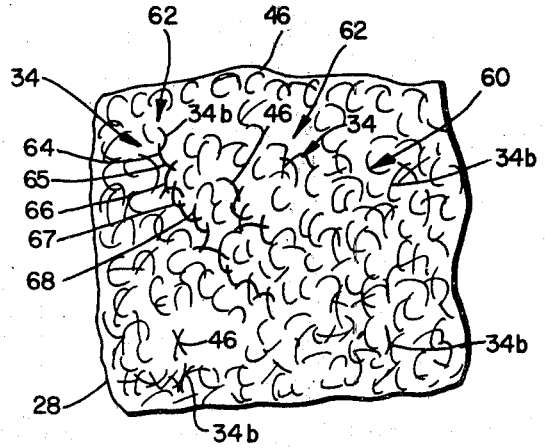
FIG. 7

ELECTRICALLY CONDUCTIVE GAME BALL

RELATED APPLICATION

This application is a continuation of application Ser. No. 77,729, filed Sept. 21, 1979, now Pat. No. 4,299,384, which is a continuation-in-part of my copending application Ser. No. 683,283 (now abandoned) filed May 5, 1976 for Electrically Conductive Game Ball, which in turn is a continuation-in-part of my copending application Ser. No. 570,766 (now abandoned) filed on Apr. 23, 1975 for Gaming Surface Contact Detecting Systems.

FIELD OF INVENTION

This invention relates to balls for playing games and having electrically conductive elements for completing a circuit between conductors which are laid in one or more selected areas where it is desired to electrically detect contact or touchdown of the ball.

BACKGROUND

Prior to this invention it has been proposed to electrically detect touchdown of a tennis ball in one or more selected areas of a tennis court by arranging a plurality of exposed spaced apart electrical conductors of a sensing circuit in the selected area or areas and by providing the ball with an electrically conductive means which is capable of bridging and, hence, completing a metallic circuit between two or more of the sensing circuit's conductors upon touchdown of the ball in the selected area. The conductors in the sensing circuit are connected to a power source in such a manner that contact of the ball with any pair of adjacent conductors in the sensing circuit completes a current-conducting path for signalling touchdown of the ball in the selected area.

Various tennis balls specifically constructed for this purpose have been proposed as described, for example, in U.S. Pat. No. 3,854,719 issued on Dec. 17, 1974 to L. D. Supran, U.S. Pat. No. 3,883,860 issued on May 13, 1975 to H. Von Kohorn, and Swedish patent No. 206,864.

In one type of prior tennis ball construction, the electrically conductive means comprises steel or other metal conductors woven into the cloth cover panels so that the cover of the ball is a composite of woven metal and fabric strands or fibers. In another type of prior tennis ball construction, the electrically conductive means takes the form of an electrically conductive coating or paint which is applied to the cover.

The latter of the two types of electrically conductive tennis ball constructions mentioned above is not acceptable for normal usage because the electrically conductive coating will wear off prematurely to objectionably shorten the effective life of the ball. On the other hand, previously disclosed tennis balls which employ a sufficient quantity of steel or other electrically conductive metal fibers or elements to assure completion of a circuit between conductors in the electrical sensing circuit are much heavier than standard non-conductive balls and are not known to meet official weight and other official requirements or standards.

Additionally, previously disclosed tennis balls employing steel or other metal coated fibers, strands or elements have the effect of objectionably discoloring tennis ball covers.

These features of the prior electrically conductive type balls have inhibited acceptance of electrical detection systems of the type described above in tennis and other games employing a ball.

U.S. Pat. No. 3,774,194 (issued to P. Jokay et al on Nov. 20, 1973) also discloses a special tennis ball constuction for use with an electrical detection system, but unlike the balls described in the three patents mentioned above, the ball in Jokay et al employs a resonant circuit which affects a radio frequency signal transmitted to a receiving antenna in a receiver.

SUMMARY AND OBJECTS OF INVENTION

One of the major objects of this invention is to provide a novel electrically conductive type ball which overcomes the foregoing features of the previously disclosed tennis balls. Moreover, tennis balls constructed in accordance with the principles of this invention meet weight and other requirements of tournament and commercial specifications and have essentially the same weight, color and playing characteristics of a standard non-conductive ball.

According to this invention, a multiplicity of unwoven electrically conductive fibers or strands are combined or incorporated with a cover of a ball to form a plurality of unwoven, electrcially conductive networks or current-conducting paths for bridging adjacent conductors in the previously described sensing or detecting circuit upon touchdown of the ball.

Some of these electrically conductive paths extend mainly along the outer surface of the cover. However, the great majority of the electrically conductive paths advantageously extend through the cover and lie mainly along the inner surface of the cover. Tennis balls incorporating this electrical network construction are not objectionably discolored and are much lighter than balls in which the electrically conductive elements are woven into the cover.

In the preferred embodiment of this invention, the electrically conductive paths mentioned above are formed by a first multitude or group of electrically conductive fibers which pierce the cover and by a second multitude or group of electrically conductive fibers lying entirely along the inner surface of the cover. The fibers in the second group are arranged in an unwoven mesh, and a large number of these fibers lie in contact with the fibers which pierce the cover to thereby complete the electrically conductive paths through the cover of the ball.

The electrically conductive fibers which pierce the cover have end portions lying on the outer surface of the cover instead of stiffly or rigidly extending from the surface of the cover. A large number of these fibers each lie in contact with at least one other electrically conductive fiber on the cover's outer surface and are hence electrically interconnected to form the unwoven electrically conductive networks or paths which extend mainly along the outer surface of the cover.

According to a further important feature of this invention the electrically conductive fibers in the first group mentioned above are needle punched into the cover, preferably in an irregular array.

In the preferred embodiment the needle punching operation is carried out by arranging a scrim (i.e., an unwoven open mesh) of the electrically conductive fibers on a selected side of a woven or felt panel to be used as the cover and by only partially needle punching the fibers into the panel so that the large majority of fibers remain unpunched to make up the second group of fibers mentioned above.

The remainder of the scrim following the needle punching operation is retained with the cover on its inner side, and the composite of the cover and scrim remainder is adhered to the body of the ball which, in the case of a tennis ball, is the inner, elastically deformable sphere.

Advantageously, a multiplicity of lightweight electrically non-conductive fibers having the same color as the cover may be mixed with the electrically conductive fibers in the scrim.

The foregoing construction and method of fabrication offer a number of significant advantages.

First, incorporation of unwoven fibers with the cover of the tennis ball does not restrict deformation or resiliency of the ball and does not adversely affect bounce requirements of the ball. Second, the addition of the electrically conductive networks on the inner surface of the cover, minimizes the number of electrically conductive fibers which are required for exposure on the cover's outer surface to contact the conductors in the electrical detection circuit. This feature significantly reduces discoloration of the cover by stainless steel or other metals employed in the fabrication of the electrically conductive fibers or strands.

Third, discoloration of the cover is further minimized by needle punching electrically non-conductive fibers having the same color as the cover into the cover along with the electrically conductive fibers.

Employment of the electrically non-conductive fibers in the scrim also affords another significant advantage. In this respect it was found that when a sufficient quantity of electrically conductive fibers are employed to make the scrim self-supporting for easy and convenient handling, the tennis ball was significantly heavier than a standard, non-conductive ball. With this invention, however, the lightweight, non-conductive fibers act as a filler in the scrim to make it self-supporting without significantly increasing the weight of the ball.

Furthermore, by distributing those electrically conductive fibers which are needle punched into the cover in an irregular array, rather than in discrete rows, the desired circuit completion between adjacent conductors in the electrical detection circuit is assured for any orientation of the ball at touchdown.

According to a further embodiment of this invention tin oxide (an essentially transparent, electrically conductive substance) coated plastic (e.g., polyester) fibers are attached to or otherwise provided on the tennis ball cover to render the cover's outer surface electrically conductive. Such embodiment avoids the discoloration problem created by the use of stainless steel or other metals for the fabrication of the electrically conductive fibers.

With the foregoing in mind, another major object of this invention is to provide a novel tennis ball which incorporates electrically conductive fibers for completing a circuit between conductors in an electrical detection circuit and which meets tournament and commercial specification.

Still another important object of this invention is to provide a novel tennis ball which incorporates electrically conductive fibers for the purpose mentioned above and which has essentially the same weight, color and playing characteristics as a standard non-conductive ball.

A further important object of this invention is to provide a novel ball for playing a game in which a quantity of unwoven networks of electrically conductive fibers are combined or incorporated with the cover of the ball to bridge spaced apart conductors in an electrical detection circuit upon contact or touchdown of the ball in a selected area.

Still another object of this invention is to provide a novel game ball and method of making the ball in which a multiplicity of electrically conductive fibers are incorporated or combined with the cover of the ball in such a manner that the great majority of conductive paths which are formed by the fibers pass through the ball's cover and extend mainly along the inner surface of the cover.

Another important object of this invention is to provide a novel game ball and method of making the ball in which a multiplicity of unwoven electrically conductive fibers are incorporated with the cover of the ball and are electrically interconnected along the exterior of the cover and through the cover and along the inner surface of the cover.

Yet another important object of this invention is to provide a novel game ball and method of making the ball in which a multiplicity of unwoven electrically conductive fibers piece the cover of the ball and have end portions lying on the outer surface of the cover.

Another important object of this invention resides in the provision of a novel game ball and method of making the ball in which a multiplicity of electrically conductive fibers are needle punched into the cover of the ball.

A further object of this invention is to provide a novel game ball and method of making the ball in which an unwoven open mesh containing electrically conductive fibers is partially needle punched into the cover of the ball from the inner side thereof and in which the unpunched remainder of the mesh is retained with the cover on the inner side thereof in the final product.

Another important object of this invention is to provide a novel game ball and method of making the ball in which lightweight electrically non-conductive fibers are mixed with the electrically conductive fibers in the unwoven mesh mentioned in the preceding object to make the mesh self-supporting without increasing the concentration of the heavier electrically conductive fibers in the mesh.

Yet another object of this invention is to provide a novel game ball and method of making the ball in which the lightweight electrically non-conductive fibers mentioned in the preceding object have the same color as the cover of the ball and in which a quantity of the electrically non-conductive fibers are needle punched into the cover along with the electrically conductive fibers in irregularly interspersed relation with the electrically conductive fibers.

Still another object of this invention is to provide a novel game ball in which a multiplicity of tin oxide coated synthetic fibers are incorporated with the cover of the ball to provide conductive paths which are effective to bridge spaced apart conductors in an electrical detection circuit upon touchdown of the ball in a selected area.

A further object of this invention is to provide a novel game ball in which the electrically conductive paths are provided by silver-plated or silver coated fibers and in which the cover of the ball is adhered to the body of the ball with an adhesive which is free of sulphur or other oxidation agents.

Further objects of this invention will appear as the description proceeds in connection with the appended claims and below-described drawings.

DESCRIPTION OF DRAWINGS

FIG. 1 is an elevation of a tennis ball incorporating the principles of this invention and showing the ball touching down on and deformed against a surface containing conductors of the electrical detection system;

FIG. 1A is a simplified schematic circuit diagram of an electrical detection circuit used in conjunction with the ball;

FIG. 2 is an elevation of the ball shown in FIG. 1, but in undeformed condition and with portions of the ball broken away to illustrate interior details;

FIG. 3 is a bottom plan view of the ball shown in FIG. 1 as viewed from lines 3—3 of FIG. 1;

FIG. 4 is an enlarged, fragmentary view of the outer surface of the ball shown in FIG. 1 and illustrating details of the unwoven electrically conductive networks which are incorporated with the cover of the ball;

FIG. 5 is a fragmentary cross section of the ball shown in FIG. 1;

FIG. 6 is a partially schematic view showing the arrangement of the scrim or unwoven open mesh of fibers and cover panel in a needle punching machine;

FIG. 6A is a bottom plan view of the needle-carrying head of the needle-punching machine shown in FIG. 6;

FIG. 7 is an enlarged, fragmentary view of the inner surface of the ball's cover and illustrating the unwoven, electrically conductive networks extending along the inner surface of the cover;

FIG. 8 is an enlarged fragmentary elevation of one of the needles in the needle-punching machine which is illustrated in FIGS. 6 and 6A; and FIG. 9 is an enlarged fragmentary view of another tennis ball embodiment in which metallic fibers or strands are wound around non-conductive fibers and strands to form the electrically conductive elements.

DETAILED DESCRIPTION

In the embodiment of FIGS. 1–7 the electrically conductive ball incorporating the principles of this invention is shown to be a tennis ball and is generally indicated at 20. Ball 20 is adapted to be used with an electrical detection system of the type which employs an electrical sensing circuit arranged in one or more selected areas where it is desired to sense or detect contact or touchdown of the ball.

In the simplified circuit diagram illustrated in FIG. 1A, the electrical sensing circuit is generally indicated at 21. Circuit 21 may comprise a plurality of exposed, preferably parallel spaced apart conductors of which two are indicated at 22 and 24. In this example, alternate conductors of circuit 21 are adapted to be electrically connected to one terminal of a voltage source, and the remaining conductors in circuit 21 are adapted to be electrically connected to the other terminal of the voltage source. Ball 20 upon contacting or touching down in the selected area is effective to complete an electrical circuit between two adjacent conductors such as conductors 22 and 24 as shown in FIG. 3.

Completion of the circuit between conductors 22 and 24 is through a conductive portion of the ball and produces a signal to indicate contact or touchdown of the ball in the selected area. Examples of this type of electrical detection system are described in my parent application Ser. No. 570,766 (now abandoned), in U.S. Pat. No. 3,854,719 and 3,883,860 and in Swedish Pat. No. 206,864. It will be appreciated, however, that a ball constructed in accordance with the principles of this invention may be employed with any suitable type of electrical detection system and is not limited to the examples mentioned above.

As shown in this embodiment, ball 20 is resilient and comprises an inner, hollow, elastically deformable sphere 26 (FIG. 2) and a cover 28. Sphere 26 may be made from rubber. The interior of sphere 26 may be filled with just air or other gas under pressure. Alternatively, it may be filled with a foam material. Cover 28 may conventionally be divided into two panels 30 and 32 (see FIG. 1) of woven or felt cloth which may be cut in a conventional pattern and which are glued or adhered to the outer surface of sphere 26.

To provide the ball with the needed conductivity for completing a circuit between conductors in circuit 21, a multitude of flexible unwoven electrically conductive fibers 34 are incorporated with cover 28. A multiplicity of these electrically conductive fibers, as indicated at 34*a*, are secured or connected to cover 28 and are dispersed or distributed in a preferably irregular array over the entire exterior surface of the cover. In this embodiment, an additional multiplicity of fibers 34 are advantageously distributed on the inner surface of the cover as indicated at 34*b*.

According to one feature of this invention, fibers 34*a* are secured to cover 28 by needle punching so that they pierce the cover and have end portions exposed on the outer periphery of the ball as best shown in FIG. 5. Needle punching of the fibers is accomplished first by forming an unwoven scrim 36 (see FIG. 6) of the fibers to be incorporated with cover 28. Scrim 36 constitutes an unwoven open mesh of fibers and is in the form of a flat, stretched-out sheet in which the fibers are strung together in an irregular array in a unitary unwoven body.

As shown in FIG. 6, scrim 36 is laid over a woven or felt panel 38 of cloth, from which the individual cover panels 30 and 32 are to be cut. The composite of scrim 36 and panel 38 is arranged in a conventional needle punching machine 40 having a multiplicity of needles 42 for punching fibers in scrim 36 into the cloth panel 38.

According to another feature of this invention, needles 42, instead of being disposed in discrete rows, are staggered in an irregular array. The electrically conductive fibers 34*a* punched into the covers cut from panel 38 will therefore be in a corresponding irregular array. With this distribution of electrically conductive fibers on cover 28, completion of a circuit between conductors 22 and 24 is assured regardless of the orientation of ball 20 upon contact with the electrical sensing circuit 21.

According to one example of this invention, fibers 34 (i.e., both groups 34*a* and 34*b*) advantageously are each formed with a synthetic fiber core coated with a tin-containing oxide. The synthetic fiber core material may be a polyester such as. The tin-containing oxide coating may be Indian tin oxide (ITO), or cadmium tin oxide (CTO) or simply tin oxide (TO) itself. Such tin-containing oxides are essentially transparent, are electrically conductive and do not significantly change the color of the polyester material itself. Fibers 34 may thus be formed by coating or plating the polyester fibers with any selected one of the foregoing tin-containing oxides, thus rendering the fibers electrically conductive. The tin-containing oxide can be vacuum plated onto the polyester fibers by known processes used in the carpet manufacturing industry. The polyester fiber material is preferably the same color as the tennis ball cover itself and is visible through the essentially transparent coating of the tin-containing oxide. The original yellow, white or orange color of the tennis ball cover thus remains with no change in player visibility. Fibers 34 may be made from other suitable materials such as Nylon. Additionally, the Nylon or other synthetic fibers may be plated or coated with other electrically conductive metals such as silver, nickel, gold, platinum or cadmium. Furthermore, fibers 34 may be finely drawn stainless steel fibers. Plating or coating the synthetic fibers with one of the above-mentioned tin oxide materials or metals renders the fibers electrically conductive. As compared with stainless steel fibers, however, silver-plated Nylon fibers are less expensive and weigh less. The tin-containing oxide (Indian, cadmium or tin oxide itself) coated polyester fibers are more advantageous than the silver-plated fibers because they do not tend to discolor the ball.

In practice, scrim 36 is preferably self-supporting so that it can easily be handled and laid over the cloth panel 38 in the process of producing tennis ball covers or covers for other types of balls in accordance with the principals of this invention. The density or concentration of certain types of electrically conductive fibers required to make scrim 36 satisfactorily self-supporting, however, was found to make ball 20 too heavy, particularly in the case where stainless steel fibers are employed. This problem is avoided, according to one embodiment of this invention, by homogeneously mixing or blending a sufficient quantity of lightweight electrically non-conducting fibers 46 with the electrically conductive fibers to form a self-supporting scrim.

Fibers 46 are much lighter than fibers 34 and may be made from Nylon or other suitable lightweight material capable of being needle punched into the cloth panel 38. Advantageously, fibers 46 are dyed to be the same color as the color of cover 28.

When a mixture of fibers 34 and 46 are employed to form scrim 36, a multitude of fibers 46 will be needle punched into panel 38 along with fibers 34*a*. Thus, the cover 28 cut from panel 38 will be needle punched with a multiplicity of fibers 34*a* and a multiplicity of fibers 46 which pierce cover 28 and which are exposed on the exterior of ball 20 as shown in FIGS. 1–4.

From the foregoing it will be appreciated that the mixture of fibers 34 and 46 makes scrim 36 self-supporting without increasing the concentration of the heavier fibers 34 and hence without significantly increasing the weight of ball 20. Tennis balls constructed according to this invention therefore meet weight and bounce requirements of tournament and commercial specifications.

As compared with a ball construction employing fibers 34 alone, the mixture of fibers 34 and 46 provides a more uniform density of fibers needle punched into and otherwise incorporated with cover 28. Furthermore, by dying fibers 46 with the same color as cover 28 (such as yellow, for example) the color of cover 28 will be more uniform and more yellow (as in the case of yellow covers) as compared with balls containing stainless steel fibers or even silver-plated Nylon fibers alone. Those non-conductive fibers 46 which are needle punched into covers 28 along with fibers 34*a* are irregularly interspersed with fibers 34*a*.

The ratio of fibers 46 to fibers 34 is selected so that the weight, color and playing characteristics of ball 20 are maintained essentially the same as a standard non-conductive ball, thus making ball 20 acceptable for tournament play. For example, when silver-plated Nylon fibers are employed, the percentage of the non-conductive fibers 46 in scrim 36 may range from about 20 to 80 percent, and when stainless steel fibers are used, the percentage of fibers 46 in scrim 38 may range from about 40 to 60 percent.

As best shown in FIG. 1, the lengths and flexibility of the fibers 34 are such that the exposed portions of fibers 34*a* lie flat or generally flat on the outer surface of the ball instead of stiffly or rigidly projecting from the ball. Additionally, the concentration of the needle punched fibers 34 which are exposed on the exterior of the ball is such that groups of the electrically conductive fibers overlap or contact one another and, hence, are electrically interconnected to form a multiplicity of electrically conductive unwoven elongated linkage-like networks 50 on the exterior of the ball. Each of the networks 50 shown provides an elongated electrically conductive path and has a plurality of fibers 34 as indicated, for example, by the reference numerals 52, 53, 54, 55 and 56. The electrically conductive fibers forming each network 50 are generally serially electrically interconnected as shown.

According to a particularly important feature of this invention, the concentration or number of needles 42 is selected to be significantly less than the concentration or number of fibers in the area of the scrim engaged by the array of needles in the needle punching machine. A multiplicity of the electrically conductive fibers (as indicated at 34*b*) will consequently not be needle punched into panel 38 and will be in the remainder of the scrim after the needle punching operation is completed as shown in FIG. 7. Instead of removing the remainder of the scrim after the needle punching operation is completed, the remainder of the scrim, which contains a multiplicity of fibers 34 and a multiplicity of fibers 46, is retained with panel 38 so that when covers 28 are cut from panel 38, there will be a remainder of the scrim on one side of the cover. This side of cover 28 is employed as unexposed, inner side or face of the cover.

Upon glueing cover 38 to sphere 26, the remainder of scrim 36, which is generally indicated at 60 in FIG. 7, will therefore be sandwiched between cover 28 and sphere 26 and will be confined in place by the glue or adhesive which is applied to adhere the cover to the sphere. The fibers in the remainder of the scrim lie flat between cover 28 and sphere 26. This is sufficient number of electrically conductive fibers 34*b* in remainder 60 so that a large number of fibers 34*b* contact or overlap one another to form an additional multiplicity of unwoven, electrically conductive elongated linkage-like networks 62 on the inner side of cover 28. Each of these networks provides an elongated electrical conductive path and may be of a multiplicity of electrically conductive fibers as indicated, for example, by the fibers individually indicated at 64, 65, 66, 67 and 68. It is evident that both groups of fibers 34*a* and 34*b* are secured in place by the adhesive which adheres the cover to the sphere.

As shown, a large number of the electrically conductive fibers in networks 62 contact or electrically connect with the electrically conductive fibers 34*a* which are needle punched to pierce cover 28 to electrically interconnect networks 62 with networks 50. Thus, in the ball of this invention, a multiplicity of electrically conductive fibers, which are incorporated with cover 28, are electrically interconnected along the exterior of cover 28 and also through the cover and along the inner face of the cover.

The concentration of density of fibers 34*b* on the inner side of cover 28 (see FIG. 7) is considerably greater than the concentration of density of fibers 34*a* exposed on the outer surface of the cover. For example, the ratio of the number of electrically conductive fibers on the inner side of cover 28 to the number of exposed electrically conductive fibers on the outer surface of the cover may be from about 2:1 to as much as about 50:1. Hence the great majority of electrically conductive paths or networks extend mainly along the inner surface of cover 28 rather than the outer surface of the cover. This feature alone minimizes the number of fibers 34 on the exterior of balls 20 to avoid objectionable discoloration of the ball without sacrificing the degree or extent of conductivity needed to reliably assure completion of a circuit between conductors in the electrical sensing circuit 21 upon contact or touchdown of ball 20 with circuit 21.

When ball 20 is dropped vertically onto a surface 70 (see FIG. 1), it deforms to form a generally flat circular touchdown area or rebounding area 72 (see FIGS. 1 and 3) which is in intimate contact with the surface. The electrically conductive networks formed by fibers 34 and lying in the flattened area 72 are sufficiently long and irregularly oriented so that for any orientation of the ball at least one of the networks 50 and 62 will bridge adjacent conductors in circuit 21 to complete a circuit between the conductors. The conductive paths formed by fibers 34 and completing the circuit between adjacent conductors in circuit 21 may extend entirely along the outer surface of ball 20. They may additionally or alternatively extend from the exterior of the ball at a point of contact with one of the sensing circuits conductors as at point A, through cover 28, along the inner side of cover 28 by way of one or more of the networks 62 and then through the cover to the exterior for contact with an adjacent sensing circuit conductor at point B.

The conductors in circuit 21 are spaced apart by a nominal distance which is determined by the diameter of the ball's flattened touchdown area 72. For example, the spacing between adjacent conductors in circuit 21 may be ⅜ of an inch for a touchdown area 72 of about one to two inches in diameter. The resistivity of the electrically conductive networks 50 and 62 is low and will normally vary between 50 ohms and 500 ohms depending largely upon the number of conductive paths which are established by fibers 34 across adjacent conductors in circut 21. Fibers 34 are relatively short and usually shorter than the spacing between adjacent conductors in circuit 21. For ⅜ of an inch spacing of conductors in circuit 21, the length of fibers 34 may be about ⅛ of an inch plus the thickness of cover 28. Ball 20 is about two and one-half inches in diameter.

When silver-plated Nylon fibers are employed as the electrically conductive fibers in the manufacture of tennis balls, a glue which is free of sulphur and other oxidation agents, is required to glue cover 28 to sphere 26. Sulphur which is incorporated as an activator in glues commonly used in making tennis balls was discovered to cause oxidation of the silver plating to objectionably diminish the conductivity of the ball. Furthermore, it was found that the oxidation process initiated by the sulphur in commonly-used glues was significantly accelerated by the pressure applied to adhere the cloth cover to sphere 26, by the usual steaming operation for fluffing the ball prior to canning, and by pressure canning the balls.

Any suitable, conventional glue or adhesive, which does not contain sulphur or other oxidation agents, may be employed to adhere the cover to the sphere to avoid the objectionable oxidation of the silver-plated fibers. Additionally, when silver-plated fibers are employed, the balls are preferably manufactured in a chlorine-free atmosphere to avoid contamination of the silver plating by the presence of chlorine. When metals other than silver (e.g., stainless steel) are employed in the fiber construction, it is evident that the glue or adhesive for adhering cover 28 to sphere 26 may be of any suitable type and does not have to be free of sulphur or other oxidation agents.

From the foregoing description it is understood that fibers 34 and 46 are unwoven in the sense that they are not woven into cover 28 or with each other. Those fibers 34 lying in contact with one another, in series circuit relation or otherwise, are regarded as being electrically interconnected.

As shown in FIG. 8, needles 42 are notched at 80 to catch one or more of the fibers in scrim 36 and to force or punch the caught fibers through the cloth panel 38 as the needles are advanced to pierce the cloth. As needles 42 are withdrawn or retracted from panel 38, they release from the punched fibers so that the fibers remain in position where they pierce the cover.

By arranging the electrically conductive paths (50 and 62) so that the great majority of them extend through cover 28 and lie mainly along the inner surface of the cover, the discoloration of the cover's outer surface is greatly reduced to a level where it is not objectionable even where scrim 36 is composed entirely of electrically conductive fibers and hence does not contain any of the non-conductive fibers. Thus, as compared with prior tennis ball constructions in which the electrically conductive strands or elements are woven into the cover of the ball and hence cause objectionable discoloration, a ball constructed according to this invention is not significantly discolored and weighs less.

Although scrim 36 may be composed entirely of electrically conductive fibers, the addition of fibers 46 to scrim 36 does offer the additional significant advantages of further reducing discoloration and of making the scrim self-supporting without significantly increasing the weight of the ball.

In the embodiment of FIG. 9, the electrically conductive elements employed to form networks 50 and 62 are in the form of strands 90 each having at least one non-conductive fiber 92 and at least one electrically conductive fiber 94 which is twisted, wrapped or coiled around fiber 92. Fibers 92 may be formed from any suitable non-conductive material such as Nylon. Fibers 94 may be all metal fibers, such as finely drawn stainless steel.

In the embodiment of FIG. 9, strands 90 are employed in place of fibers 34 to make up scrim 36, and the scrim containing strands 90 is advantageously partially needle-punched into panel 38 in the manner previously described. Thus, some of the strands (as indicated at 90*a*) pierce cover 28, while the large majority of the strands (indicated at 90*b*) make up the unpunched remainder of the scrim which is positioned on the inner, unexposed side of the cover.

Advantageously, fibers 92 are dyed to have the same color as that of cover 28. When strands 90*a* are needle punched into the cover material, the loops or coils 96 of fibers 94 spread apart or separate as the strands are forced through the cover. On the exteriorly exposed portions of each strand 90*a*, therefore, the loops or coils of fiber 94 will be separated as shown to expose the fiber 92 which has the same color as cover 28. The color of fibers 92 is consequently visible to significantly reduce the discoloration caused by fibers 94.

When strands 90 are employed in place of fibers 34, therefore, fibers 46 may not be needed to further reduce discoloration.

According to another embodiment of this invention, cover 28 may be exteriorly treated or coated with an electrically conductive material which is preferably polyvinyldebenzylmethyl ammonium chloride. The ball with this coating is detected in the same manner as described in connection with the embodiment of FIGS. 1–7.

It will be appreciated that balls constructed in accordance with this invention are not limited to tennis balls and that balls for playing various games other than tennis may be constructed in accordance with the principles of this invention. It also will be appreciated that numerous features of this invention may be employed independently of each other.

It will be appreciated that such special electrically conductive fibers as the ones coated with a tin-containing oxide may be incorporated into the tennis ball cover by means other than needle punching. For example, they may be woven into or otherwise interlocked with the non-conductive tennis ball cover material. The term "coating" used herein is considered to be broad even to cover plating or any other technique of applying a film or layer of electrically conductive material to the polyester or other synthetic fibers.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A tennis ball for use with an electrical detection circuit in which touchdown of the ball in a selected area is detected by completion of a circuit between spaced apart electrical conductors lying in said area, said tennis ball comprising an elastically deformable sphere, a cover covering said sphere, a multiplicity of electrically conductive fibers incorporated into said cover and having portions on the inner and outer sides of said cover, and electrically conductive means formed separately of said fibers and said cover and lying entirely and solely between said cover and said sphere without passing through said cover and without being incorporated into said cover, said electrically conductive means being in contact with and electrically interconnecting the portions of said fibers on the inner side of said cover, said electrically conductive means cooperating with said fibers to provide an electrically conductive network extending along the inner side of said cover and passing through said cover to extend along the outer side of said cover for completing a circuit across a pair of said conductors upon touchdown of the tennis ball on said conductors.

* * * * *